United States Patent [19]

Ford

[11] 4,456,064

[45] Jun. 26, 1984

[54] WELL BORE WALL CLEANER

[76] Inventor: Lamar Ford, P.O. Box 490, Marshall, Tex. 75670

[21] Appl. No.: 471,774

[22] Filed: Mar. 3, 1983

[51] Int. Cl.[3] ..... F21B 37/00

[52] U.S. Cl. ..... 166/123; 166/241

[58] Field of Search ..... 166/173, 170–172, 166/174–176, 241; 175/406; 15/104.16

[56] References Cited

U.S. PATENT DOCUMENTS 3,276,521 10/1966 Turbyfill ..... 166/173

*Primary Examiner*—James A. Leppink
*Assistant Examiner*—Thuy Bui
*Attorney, Agent, or Firm*—Jack W. Hayden

[57] ABSTRACT

A plurality of thin plates of metal is mounted on the central raised surface portion of a collar formed by semicircular annular members that are hingedly secured together. Each of the plates includes a blade portion to contact the well bore wall; a pair of spaced legs formed by spaced strips extend from one edge of the blade portion in generally a plane transverse to the blade portion, each of the legs including: a first portion having openings therein for securing one each of the plates in one each of the openings; a second portion extending upwardly from the first portion and outwardly through the opening; and a third portion extending transversely of said second portion and forming a juncture with the blade portion along a plane generally parallel with and elevated above the central collar surface so that flexing of the blade portion is generally along the juncture of the third portion and blade portion in a plane above the raised central surface of the collar.

2 Claims, 4 Drawing Figures

WELL BORE WALL CLEANER

SUMMARY OF THE INVENTION

The present invention is an improvement over my prior U.S. Pat. No. 3,276,521 issued on Oct. 4, 1966. The device of such patent generally functions satisfactorily except that it has been found that the manner in which the blades are mounted on the collar therein provides substantial stress on the securing means which secure the thin plates to the collar. Also, the plane in which the blade portion of the thin plates generally deflects or bends is substantially in the same plane as the collar and securing means. This does not, for some reason, always enable the blade portion to properly return or reassume its position after contact with the well bore wall.

An object of the present invention is to provide a plate configuration which overcomes this problem in that it enables the blade to deflect in a plane which is elevated in relation to the plane where the blade portion is secured to the collar which seems to substantially reduce the stress on the securing means and thereby avoids premature dislodging of the plates from the collar.

Furthermore, such arrangement enables the thin plates which are formed of spring steel to more affirmatively reassume their original position relative to the collar after deflection by contact with the well bore wall for cleaning thereof.

As described in my prior U.S. patent, it is desirable to remove the drilling fluid cake and other residuals from a well bore wall prior to cementing operations and prior to finalizing the completion of an oil or gas well.

As noted previously, the present invention is an improvement over my prior device in that it assures that the plates or blades which contact the well bore wall to remove the debris therefrom as the device is lowered into the well bore on a tubular string will perform their intended function, and will be maintained in proper position on the collar as well as in proper position outwardly therefrom to engage the well bore wall and remove the undesired coating therefrom.

DESCRIPTION OF THE PREFERRED EMBODIMENT

Figure 1:
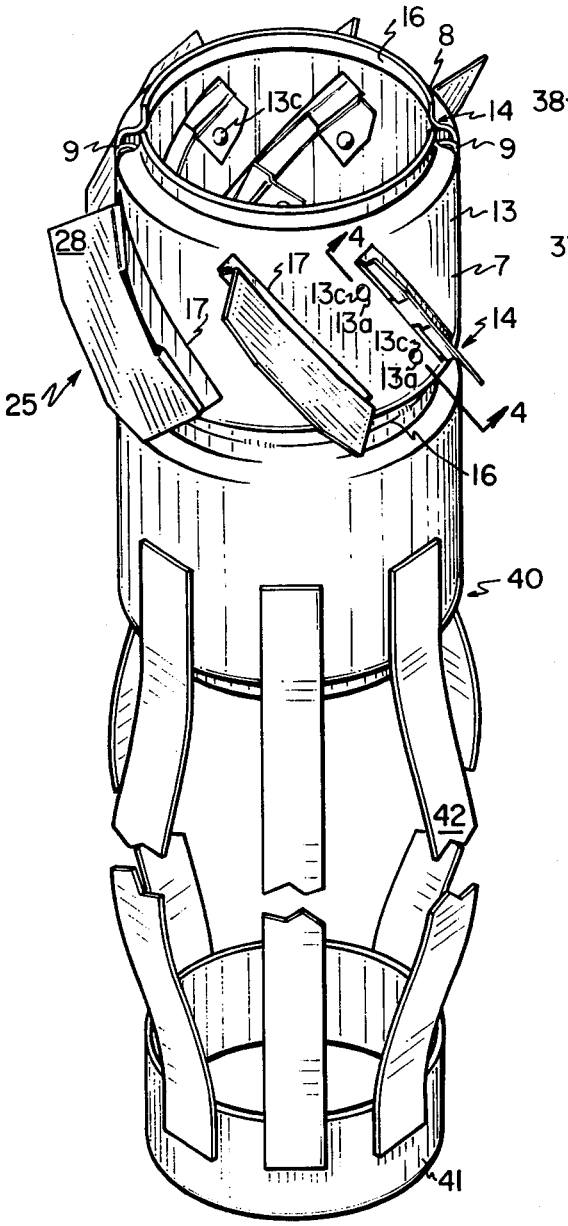
FIG. 1 is an elevational view illustrating one form of the apparatus.

Attention is first directed to FIG. 1 of the drawings wherein a pair of semicircular members 7 and 8 is shown which is hingedly secured together any suitable means such as illustrated at 9 along their longitudinal edges to form a ring or collar referred to generally by the numeral 12. The collar 12 includes a central, longitudinally and annularly extending surface 13 with an inwardly extending portion referred to generally by the numeral 14 at each end thereof. The inwardly extending end portions 14 form or provide longitudinally and annularly extending rings 16 at each end of each of the semicircular members and hence the collar 12 for abutting or fitting closely adjacent the tubular member on which the apparatus is positioned in a manner well known in the art as the well bore string is lowered into the well bore. The rings 16 space or elevate the raised central surface 13 relative to the tubular member and provide a space for receiving and securing the thin plates referred to generally by the numeral 25 to the collar 12, which plate details will be described in greater detail hereinafter.

The central portion 13 of the collar 12 is provided with a plurality of circumferentially spaced openings 17 which are disposed at an angle relative to the longitudinal axis of the collar 12 as demonstrated in FIG. 1 of the drawings.

Figure 2:
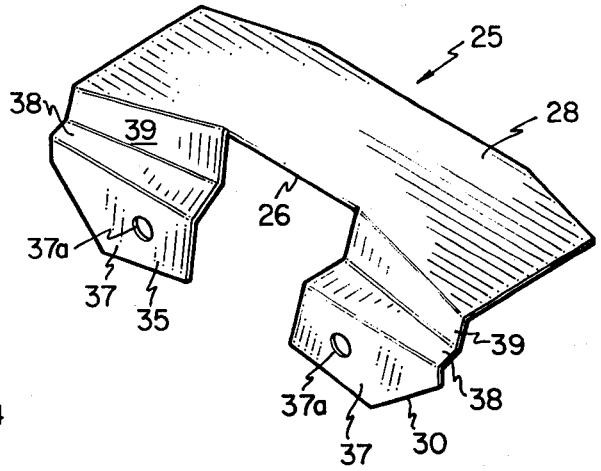
FIG. 2 is a perspective view illustrating the configuration of the thin plate of the present invention.
Figure 3:
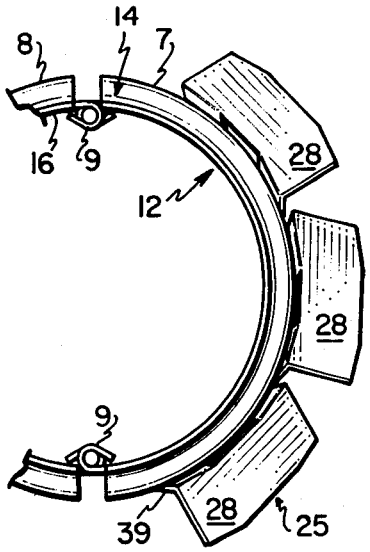
FIG. 3 is a partial end view illustrating a pair of semicircular annular members hingedly secured together to form a collar on which the thin plates are mounted.

The configuration of the thin plate of the present invention positioned in each of the openings 17 is more clearly seen in FIG. 2 of the drawings. Each of such plates 25 includes a blade portion 28 for projecting generally radially outwardly of the raised surface 13 of the collar 12 to engage or contact the well bore wall for cleaning thereof as the device is lowered into the well bore on the tubular member on which it is supported. A pair of spaced legs referred to generally at 30 and 35 is formed in spaced strips which extend from one edge 26 of the blade portion 28. The spaced legs 30 and 35 extend generally in a plane transverse to the plane of the blade portion and each of the spaced legs 30 and 35 includes a first portion 37, each of which first portions 37 has an opening 37*a* therein for securing each of the legs 30, 35 and one each of said thin plates 25 in one each of the openings 17. More specifically, the openings 37*a* are aligned with openings 13*a* in the central portion 13 of the collar 12 and a brad or other suitable means is engaged through the openings to position the thin plates on the collar 12 as illustrated in the drawings. The first portions 37 of each leg are formed in each leg so as to fit closely adjacent the inner surface of raised surface 13 of collar 12 to enable the plates 25 to be secured on the collar 12 so blade portion 23 will project through its opening 17.

Figure 4:
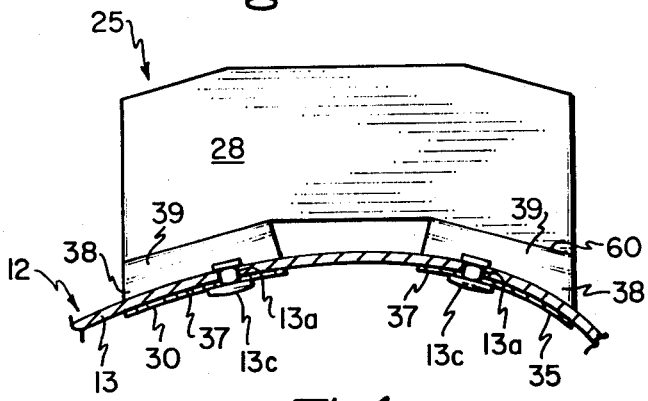
FIG. 4 is a partial sectional view on the line 4—4 of FIG. 1.

A second portion 38 on each leg 30 and 35 extends upwardly from each of the first portions 37 and projects upwardly and outwardly through the opening 17 in the central portion 13 of the collar 12 as more clearly seen in FIG. 1. Each of the strips forming each leg 30 and 35 is then bent again to provide a third portion 39 that extends transversely of each of the second portions 38 and forms a juncture with the blade portion 28 of the thin plates 25 along a plane that generally conforms with or is generally parallel with and elevated above the central surface 13 of collar 12. The elevated plane at the juncture of portions 28 and 39 is more clearly seen in FIG. 4 and is represented at 60.

It is to be noted that the thin plates 25 are formed of spring steel material, and the legs 30 and 35 of each plate 25 are formed by the strips of continuous material which extend from one edge of the blade portion 28 as shown. More specifically, by bending the spaced strips from which the legs are formed so as to provide in each leg a first, second and third leg portion in the manner hereinabove described serves to position the blade portion 28 so that the plane 60 along which it tends to flex or bend is at the juncture of the third portion 39 with the lower or innermost edge portion of the blade portion 28. Thus, flexing of the blade portion at a plane above the plane of the central surface 13 is accomplished. Also, it has been found that when the plate is formed in this manner, the flexing of the blade portion is not in substantially the same plane as the surface of the 13 with which the thin plates 25 are affixed, and this seems to reduce the stress and strain on the studs 13c which secure the plates 25 in each of the openings 17.

Additionally, this arrangement also enhances the returning of the blade portion 28 to its radially extending position as illustrated in the drawings. Although the plates 25 are formed of spring steel, in some circumstances it has been found that their contact with the wall of the well bore is with sufficient impact so as to tend to bend them in a manner which may permanently distort them, or to disconnect the securing studs 13c from the central portion 13 of the collar. This arrangement for some unexplained reason enables the blade portions 28 to absorb more shock and impact and retain their resiliency so as to enable them to return to their original positions.

It is to be further noted that the openings 17 are substantially wider as can be seen from FIG. 1 of the drawings than the width of the material from which the thin plates 25 are formed which enables the plates 25 to be readily positioned and placed on the collar 12 for securing therewith. The apparatus may be secured at the upper end of a central locating means referred to at 40 which includes a collar 41 that is spaced longitudinally from the collar 12 with outwardly extending bow spring members 42.

The foregoing disclosure and description of the invention are illustrative and explanatory thereof, and various changes in the size, shape and materials as well as in the details of the illustrated construction may be made without departing from the spirit of the invention.

What is claimed is:

1. An apparatus for positioning on a tubular member to be lowered into a well bore for cleaning the sides thereof comprising:

a. a pair of semicircular annular members;

b. means for hingedly securing said semicircular members together to form a collar for positioning on a tubular member;

c. said collar including a central, longitudinally and annularly extending surface with an inwardly extending portion at each end providing longitudinally and annularly extending rings at each end of said collar for abutting the tubular member and to space said central surface from the tubular member;

d. said central portion having a plurality of spaced openings disposed at an angle to the longitudinal axis of said collar;

e. a plurality of thin plates of metal, each of said plates including:

(1) a blade portion for projecting generally radially outwardly of said collar to contact the well bore wall;

(2) a pair of spaced legs formed by spaced strips extending from one edge of said blade portion in generally a plane transverse to said blade portion, each of said legs including:

(a) a first portion having openings therein for securing one each of said plates in one each of said openings;

(b) a second portion extending upwardly from said first portion and outwardly through said opening in said collar; and (c) a third portion extending transversely of said second portion and forming a juncture with said blade portion along a plane generally parallel with and elevated above said central collar surface whereby said first, second and third portions cooperate to provide flexibility and resiliency to said blade portion and to enable said blade portion to more readily reassume its position relative to said collar after deflection by contact with the well bore wall.

2. The apparatus of claim 1 wherein said spaced openings are substantially wider than said thin plates wherein said first, second and third portions are arranged so that flexing of said blade portion is generally along the juncture of said thrid portion and blade portion in the elevated plane above said central surface and further wherein the apparatus includes a second longitudinally spaced collar formed by hingedly secured semicircular portions, and there being outwardly extending bow spring members extending between said longitudinally spaced collars.

* * * * *